US005152625A

United States Patent [19]

Machii

[11] Patent Number: 5,152,625

[45] Date of Patent: Oct. 6, 1992

[54] DUAL USE OF RIBBON SENSOR IN A PRINTING DEVICE

[75] Inventor: Ritsuo Machii, Tokyo, Japan

[73] Assignee: Canon Kabushiki Kaisha, Tokyo, Japan

[21] Appl. No.: 796,883

[22] Filed: Nov. 25, 1991

Related U.S. Application Data

[63] Continuation of Ser. No. 324,046, Mar. 16, 1989, abandoned.

[30] Foreign Application Priority Data

Apr. 13, 1988 [JP] Japan ..... 63-89105

[51] Int. Cl.[5] ..... B41J 35/36

[52] U.S. Cl. ..... 400/711; 400/212; 400/216.1; 400/219; 400/239; 400/249

[58] Field of Search ..... 400/212, 216, 216.1, 400/216.2, 217, 217.1, 218, 219, 219.1, 238, 239, 249, 703, 711

[56] References Cited

U.S. PATENT DOCUMENTS

| | | | |
|---|---|---|---|
| 4,494,886 | 1/1985 | Kondo et al. | 400/212 |
| 4,563,100 | 1/1986 | Hamamichi | 400/216.1 |
| 4,712,000 | 12/1987 | Yoshikawa et al. | 250/205 |
| 4,798,489 | 1/1989 | Shiota | 400/216.1 |

FOREIGN PATENT DOCUMENTS

| | | | |
|---|---|---|---|
| 4084 | 1/1985 | Japan | 400/249 |
| 258783 | 11/1986 | Japan | 400/239 |
| 189188 | 8/1987 | Japan | 400/217 |
| 256683 | 11/1987 | Japan | 400/212 |

*Primary Examiner*—David A. Wiecking

*Attorney, Agent, or Firm*—Fitzpatrick, Cella, Harper & Scinto

[57] ABSTRACT

A recording device in which an ink ribbon is used and recording is performed shifting the ribbon in the direction of the width of the ribbon and having a sensor for detecting the end of an effective portion of the ribbon. Using the end sensor, the vertical position of the region of the ribbon used for recording is detected.

13 Claims, 5 Drawing Sheets

DUAL USE OF RIBBON SENSOR IN A PRINTING DEVICE

This application is a continuation of application Ser. No. 07/324,046 filed Mar. 16, 1989, now abandoned.

BACKGROUND OF THE INVENTION

1. Field of the Invention

This invention relates to a recording device, and more particularly, to a recording device such as an impact type electronic typewriter or the like that uses an ink ribbon and operates by vertically shifting the ink ribbon to use different regions along the width of the ink ribbon and position it in a non-printing position.

2. Description of the Prior Art

Heretofore, this kind of recording device often required a ribbon-shifting mechanism which shifts the ink ribbon downward to a non-printing position so as not to hinder reading of recorded characters between printing strikes of the hammer. When printing is to take place, the ribbon shifting mechanism shifts the ink ribbon upward and in front of a recording head. Furthermore, in the high-end categories of this kind of device, as disclosed in U.S. Pat. No. 4,494,886, there has been adopted a configuration in which a so-called end sensor for detecting an end of the effective portion of the ink ribbon is provided, and recording is automatically stopped when the sensor has detected the end of the ribbon.

In this kind of device, it is common, such as shown in FIG. 7, that the width of the ink ribbon 19 is a little larger than the height of the largest characters, such as shown by A–F, and in that case the entire width of the ribbon is used for the printing of one character.

Recently, however, there have been developed devices in which a wide ink ribbon is used in order to increase the area usable for printing. In these devices, the ribbon is shifted in the vertical direction in plural stages, and thus printing can be performed by utilizing the ink ribbon width in a multistage way. FIG. 8 illustrates an applicational example thereof. In FIG. 8, and ink ribbon 9, the width of which is a little larger than 3 times the height of the largest characters, as shown by characters A–F, is used. The ribbon is divided into 3 rows each of which is used for the printing of one character, and printing is performed by successively shifting the ribbon in the order of the upper row, middle row and lower row as shown by arrows. Because the width of the ribbon 9 is larger than three times the height of the largest of the printed characters, there exists a non-printing region along the top and bottom edges of the ribbon 9.

In such devices for performing multistage printing, a motor which performs exact position control, such as a stepping motor or the like, is used for the shift control of the ink ribbon vertically; i.e. upward and downward in the direction of its width, and thus shift control is performed with a high accuracy. Now, in such devices, the position of the ink ribbon is not set when the power supply of the device is turned off. Hence, it is necessary to shift the portion of the ink ribbon used for printing precisely to a predetermined initial position (waiting position under non-printing situation) immediately after the power supply of the device has been turned on.

Two methods of achieving the above described objectives have been disclosed in Japanese Patent Publication No. 32317/1984. In one of these methods, the position of the usable portion of the ink ribbon in the direction of the width of the ribbon is detected by an exclusive sensor, the detected result is stored in a memory fed by a backup power supply, and the information of the position in the direction of the width of the ink ribbon portion to be used is located in the memory and is output to a control system when the power supply is turned on. In the other method, there is provided initializing means, which is operated when the power supply is turned on, and an ink-ribbon cassette housing an ink ribbon is pivoted to a predetermined position in the direction of the width of the ribbon, and at the same time, the ribbon is advanced in a longitudinal direction in order to prevent reusing the same portion of the ribbon.

In the former method described above, however, there is a problem that a sensor for detecting the position of the ink ribbon in the direction of the width, a memory for storing the detected result and a power supply for backup are needed, and this causes increase in cost.

In the latter method, there is also a problem that the provision of the initializing means causes an increase in cost.

SUMMARY OF THE INVENTION

It is an object of the present invention to provide an inexpensive configuration in which the vertical position of a portion of an ink ribbon to be used for recording can be detected.

It is still another object of the present invention to provide a configuration in which the vertical position of the portion to be used for recording of the ribbon is detected, using an end sensor for detecting an end of an effective portion of the ribbon.

These and other objects of the present invention will become more apparent from the following description of the concrete embodiment taken in connection with the drawings.

DESCRIPTION OF THE PREFERRED EMBODIMENT

An embodiment of the present invention will now be explained in detail with reference to the drawings.

Figure 1:
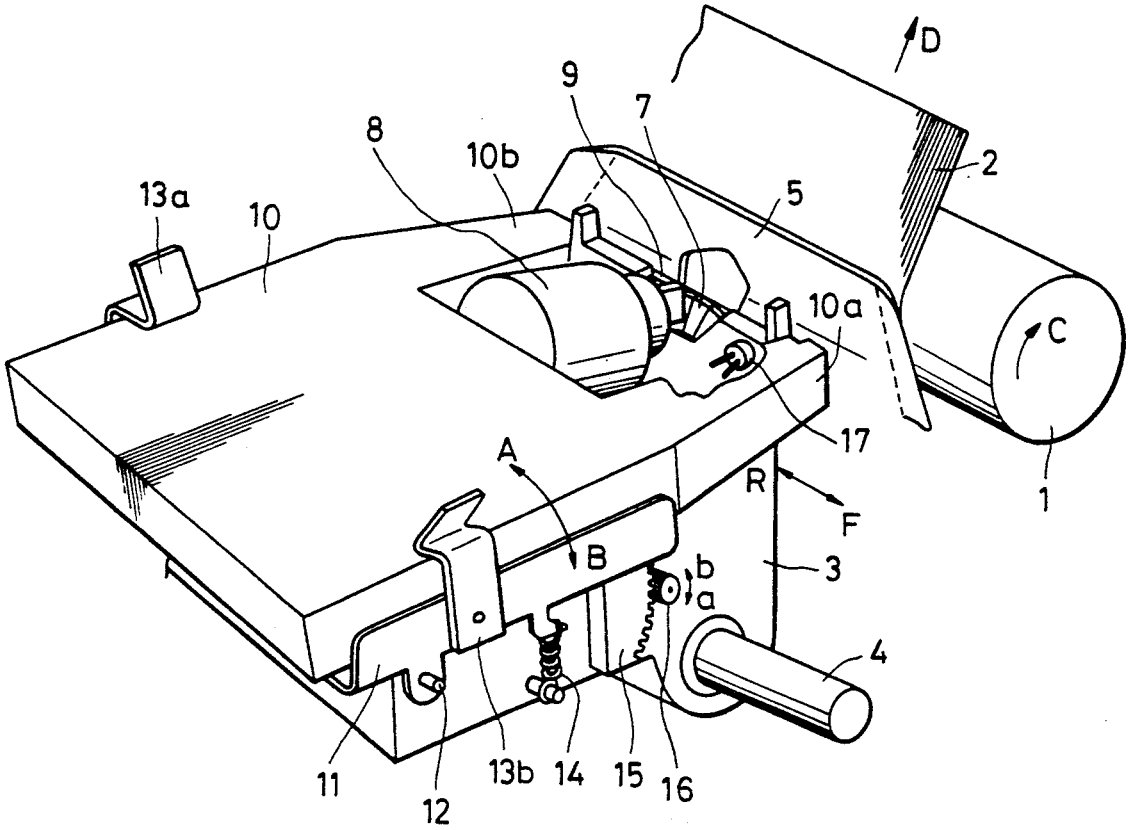
FIG. 1 is a perspective view showing the structure of a recording mechanism of an electronic typewriter according to an embodiment of the present invention.
Figure 8:
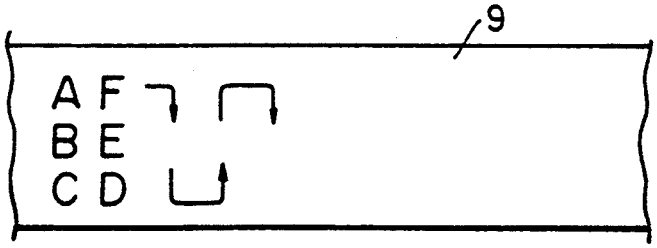
FIG. 8 PRIOR ART
FIG. 8 is an explanatory diagram of an ink ribbon for multistage printing and its state of application.

FIG. 1 shows the configuration of a recording unit as a principal unit of a print-impact electronic typewriter for performing the above-described multistage printing as shown in FIG. 8, as an embodiment of the present invention. In the configuration of FIG. 1, a platen 1, which acts as a recording support and a paper-feeding roller, winds and supports a printing paper 2, and is rotated by the drive of a paper feeding motor (not illustrated) as shown by the arrow C to feed the printing paper 2 as shown by the arrow D.

A guide shaft 4 is installed in parallel with the platen 1 in a lower portion near the front side supporting the printing paper 2 of the platen 1, and a carriage 3 is slidably supported on the guide shaft 4. The carriage 3 slides on the guide shaft 4 in parallel with the platen 1 in the directions of the arrows F and R by the drive of a carriage motor (not illustrated).

A card holder 5 for guiding the printing paper 2 along the platen 1 is provided between the platen 1 and the carriage 3. Behind the card holder 5 there is mounted on the carriage 3 a type wheel 7, which is rotated by the drive of a wheel motor (not illustrated). A printing hammer 8 for striking a type in the type wheel 7 is also provided behind the type wheel 7 as a recording head.

An ink ribbon cassette (abbreviated hereinafter a ribbon cassette) 10, which houses an ink ribbon 9, includes arms 10*a* and 10*b* for stretching the printing portion of the ribbon 9 and is also removably mounted on the carriage 3. The ribbon cassette 10 is removably held by and mounted on a ribbon frame 11 of a cassette-holding member provided on the carriage 3 via click members 13*a* and 13*b*. The ribbon frame 11 is provided so as to be pivotable centering around a shaft 12 in the directions of the arrows A and B on the carriage 3, and is energized in the direction B by a spring 14 stretched between the carriage 3 and the ribbon frame 11. At a right end portion in FIG. 1 of the lower surface at the free end of the ribbon frame 11, there is protrudently mounted a rack 15, which is meshed with a pinion gear 16 rotated by a shift motor (not illustrated) for shifting the ink ribbon 9.

By the rotation of the pinion gear 16 in the direction a or b by the drive of the shift motor, the ribbon frame 11 is rotated in the direction A or B via the rack 15, thereby rotating the ribbon cassette 10. As a result, the portion of the ink ribbon 9 which is stretched between the arms 10*a* and 10*b* is shifted vertically in the upward and downward directions in FIG. 1. The shift motor (not illustrated) consists of a stepping motor.

Figure 2:
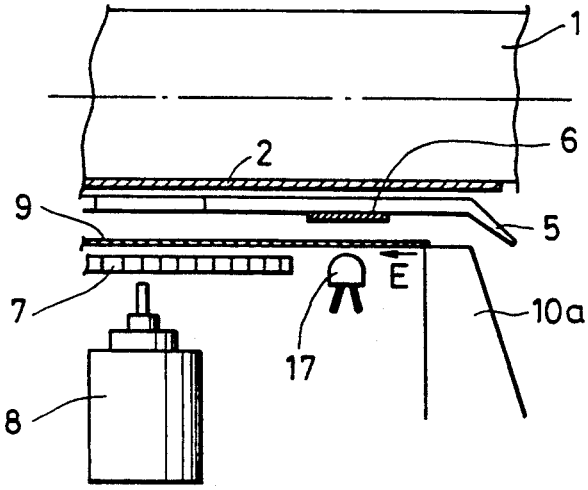
FIG. 2 is a plan view of the area of the recording device wherein the end sensor as shown in FIG. 1 is located.

On the carriage 3, there is also provided an end sensor 17 for detecting an end of an effective portion; that is, the portion used for printing, of the ink ribbon 9. The end sensor 17 faces the stretched portion used for printing of the ink ribbon 9 at a predetermined position near the inner side of a front-end portion of the one arm 10*a* of the ribbon cassette 10 as shown in FIG. 2. Although not illustrated in detail, the end sensor 17 is configured as a reflect-type optical sensor which comprises a light-emitting device such as a light-emitting diode or the like, and a photosensor such as a phototransistor or the like for receiving the reflected light from the emission from the light-emitting device. In order to detect the end of the effective portion of the ink ribbon by the end sensor 17, there is provided on the ink ribbon an end-indicating region 9*a* the reflectivity of which is markedly higher than that of the above-described effective portion at an end portion of the ink ribbon 9. In this embodiment, it is assumed that the effective portion of the ink ribbon 9 is black in color, and the end indicating region 9*a* is white in color. The output level of the end sensor 17 varies depending on whether the light is reflecting off an effective portion of the ink ribbon 9 or is reflecting off the end-indicating region having a higher reflectivity than the effective portion of the ink ribbon 9. Thus, when the end-indicating region 9*a* is detected, it is known that the end of the effective portion of the ink ribbon 9 has been reached.

On the other hand, as described later, in order to detect whether the position of the above-described stretched portion is located at a predetermined initial position relative to the width of the ribbon (waiting position under non-printing situation) by detecting an upper edge of the stretched portion of the ink ribbon 9, a back sheet 6 the reflectivity of which is markedly higher than that of the effective portion of the ink ribbon 9 is attached on the back surface of the card holder 5 at a position facing the end sensor 17, as shown in FIG. 2. In the present embodiment, it is assumed that the back sheet 6 is also white in color. As described later, the vertical position of the ink ribbon 9 is detected by whether the end sensor 17 detects the back sheet 6 having a high reflectivity or not in accordance with the position of the stretched portion of the ink ribbon in the direction of the width of the ribbon.

Next, the configuration of a control system of the typewriter of the present embodiment will be explained with reference to FIG. 3.

Figure 3:
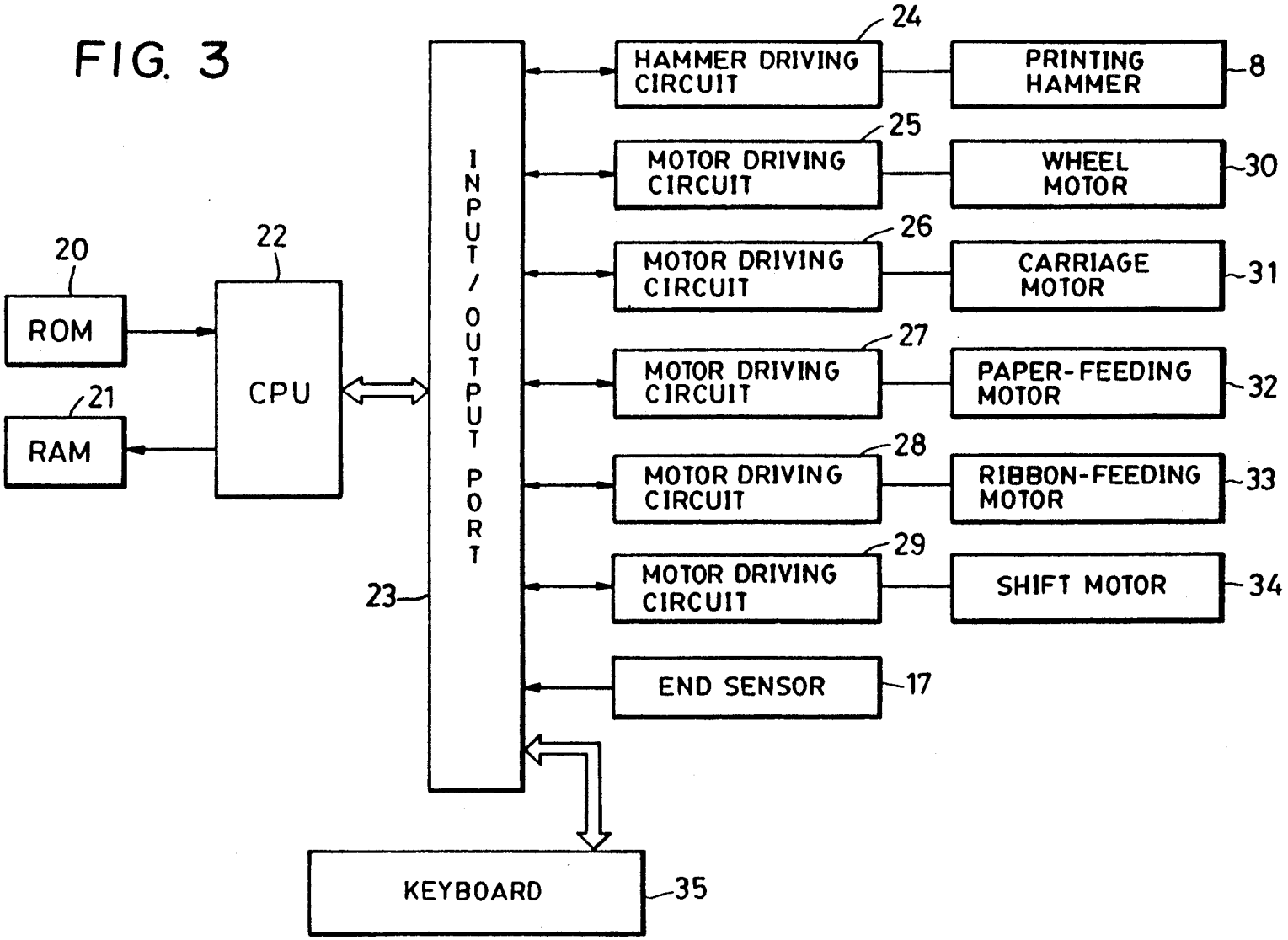
FIG. 3 is a block diagram showing the configuration of a control system of the typewriter shown in FIG. 1.

In the configuration of the control system shown in FIG. 3, a CPU (Central Processing Unit) 22 controls the entire typewriter. A ROM (Read-Only Memory) 20 stores control programs and fixed data and the like which are necessary for control and a RAM (Random Access Memory) 21 is used for temporary storage of printing data and the like and as a working area are associated with the CPU 22. The previously-described printing hammer 8, a wheel motor 30 for rotating the type wheel 7, a carriage motor 31 for driving the carriage 3, a paper-feeding motor 32 for feeding the printing paper 2 by rotating the platen 1, a ribbon-feeding motor 33 for feeding the ink ribbon 9 by rotating a winding reel (not illustrated) within the ribbon cassette 10 and a shift motor 34 for shifting the ink ribbon 9 by rotating the pinion gear 16 are connected to the CPU 22 via driving circuits 24–29, respectively, and an input-/output port 23. A keyboard 35 which is an operation input unit for inputting printing data and the previously-described end sensor 17 are also connected to the CPU 22 via the input/output port 23. Although a display unit of the typewriter, other sensors and the like are also connected to the CPU 22, illustration and explanation thereof will be omitted.

Under such configuration, the CPU 22 performs control processing according to control programs stored in the ROM 20 using the RAM 21 for temporary storage of printing data and as a working area and the like. That is, the CPU 22 performs driving control of the printing hammer 8, the wheel motor 30, the carriage motor 31, the paper-feeding motor 32, the ribbon-feeding motor 33, the shift motor 34 and the like via the driving circuits 24–29, and thus there is performed printing of printing data input from the keyboard 35. Using the end sensor 17, the CPU 22 also detects the end of the effective portion of the ink ribbon 9, and detects the initial position of the vertical shift position of the stretched portion used for printing of the ink ribbon 9 in the direction of the width of the ribbon.

Next, operation of the typewriter of the present embodiment will be explained.

First, when a command for printing one character has been input from the keyboard 35, the type wheel 7 is rotated, and a type key corresponding to the input printing data is positioned at the striking position of the printing hammer 8. The printing hammer 8 is then driven to strike the type key, which strikes the ink ribbon 9 against the printing paper 2 on the platen 1, whereby an ink pattern corresponding to the type key is transferred to the printing paper 2, and thus printing of one character is performed. When the printing of one character has been completed, the carriage 3 is moved by a predetermined pitch covering one character, for example, in the direction F in FIG. 1, and printing of one line is performed by repeating this operation. When printing of one line has been completed, the platen 1 is rotated in the direction C, and line feed is performed by feeding the printing paper 2 by a predetermined amount covering one line in the direction D.

Figure 4:
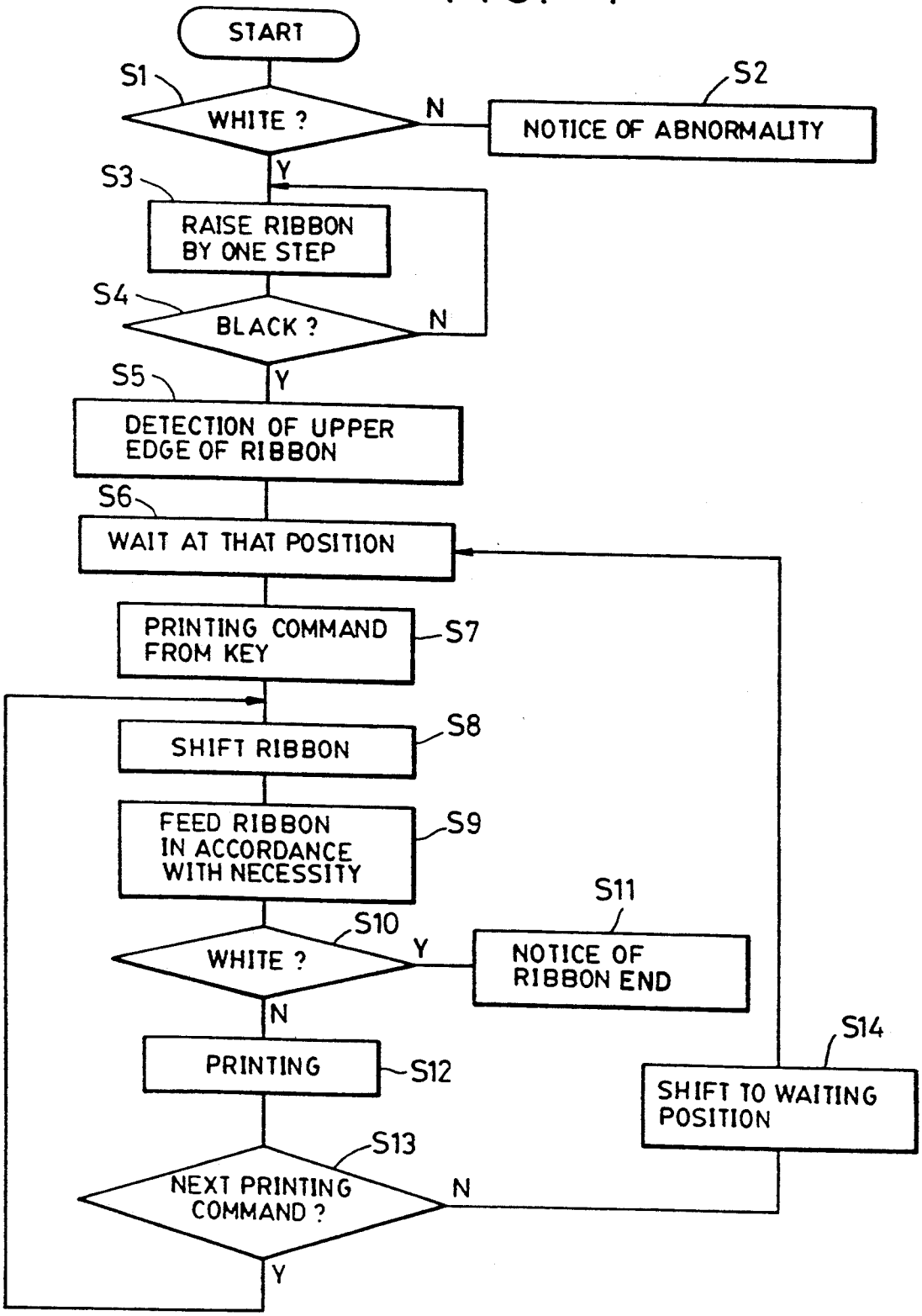
FIG. 4 is a flow chart showing a processing procedure of a control by the CPU as shown in FIG. 3 as it relates to an ink-ribbon shift operation.
Figure 5:
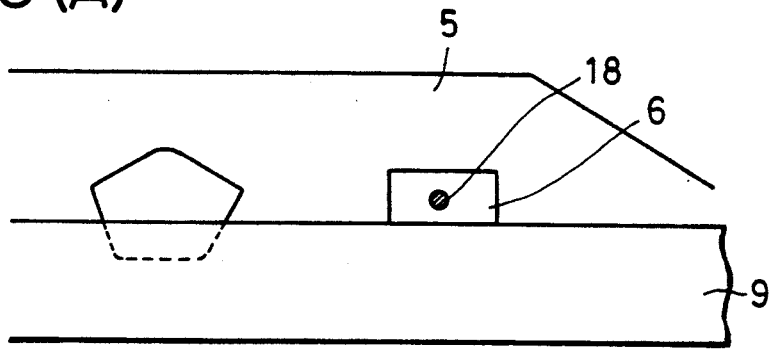
FIGS. 5 (A)–5 (D) are explanatory diagrams of vertical detection of the shift positions of the ink ribbon and shift operations, respectively.
Figure 5:
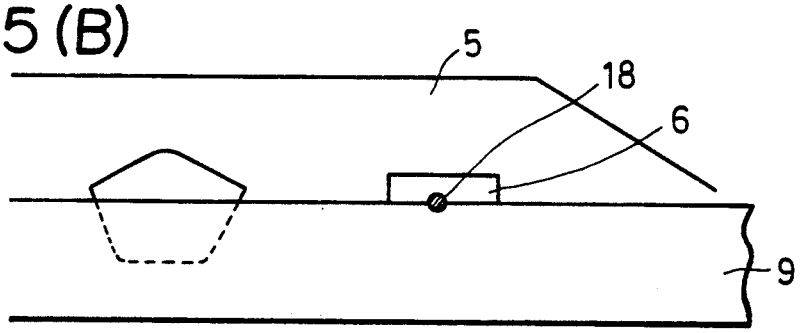
Figure 5:
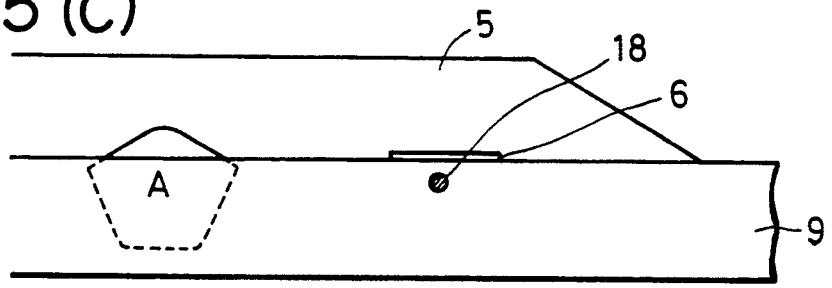
Figure 5:
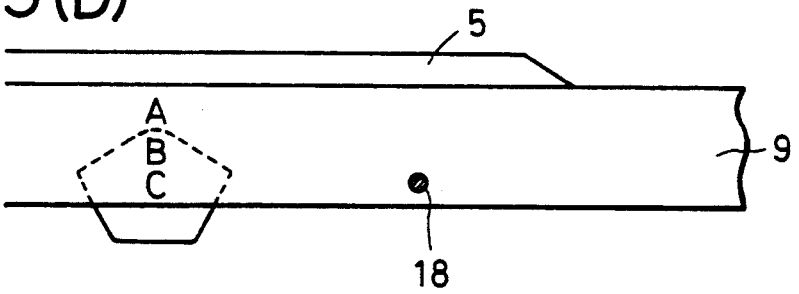

When the power supply of the typewriter in the present embodiment is on, the stretched portion of the ink ribbon 9 is vertically shifted to a predetermined initial position (waiting position under non-printing situation). During printing, shift to three-staged printing positions is performed as shown in FIG. 8. While printing data are not continuously input, the stretched portion of the ink ribbon 9 is vertically shifted to the above-described waiting position. The details of control operation of the CPU 22 in FIG. 3 which performs the control of such vertical shift operation will be hereinafter explained with reference to FIGS. 4 and 5 (A)–5 (D). FIG. 4 is a flow chart showing a control procedure of the CPU 22 corresponding to a control program stored in the ROM 20. FIGS. 5 (A)–5 (D) are explanatory diagrams of the shift-position detection and shift operation.

First, under a state in which the power supply of the electronic typewriter is off, in the configuration of FIG. 1, the ribbon frame 11 is pivoted in the direction B energized by the spring 14, and thereby the stretched portion of the ink ribbon 9 is vertically shifted to a predetermined initial position (waiting position under non-printing situation) which is lower than the type-striking position (printing position) of the type wheel 7. The predetermined initial position is shown in FIG. 5 (A) relative to the card holder 5. That is, the ink ribbon 9 is vertically shifted to a position facing the lower portion of the back sheet 6. In FIG. 5 (A), there is also shown a detection point 18 to be detected by the end sensor 17. Under this state, the ink ribbon 9 is situated lower than the detection point 18, and so the highly reflective white portion of the back sheet 6 is detected by the end sensor 17.

When the power supply of the electronic typewriter has been turned on from this state, the CPU 22 first investigates whether the detected output of the end sensor 17 is white, that is, whether the white portion of the back sheet 6 is detected. This is shown as step S1 in FIG. 4. If the effective portion of the ink ribbon 9 is detected, the vertical position of the ink ribbon 9 is determined to be abnormal, that is, not at the position in FIG. 5 (A). Hence, some processing is performed, for example, notice of the abnormality via a display unit (not illustrated) or the like at step S2, and the printing operation is prohibited until the abnormality has been dissolved.

On the contrary, if the output of the end sensor 17 is white it has been determined that the state is normal, whereupon the CPU 22 enters the repeating loop of steps S3 and S4. In steps S3 and S4 the shift motor 34, which consists of a stepping motor, raises the ribbon one step at a time until the detected output of the end sensor 17 becomes black, that is, until the effective portion of the ink ribbon 9 is detected, and thus the stretched portion of the ink ribbon 9 is shifted upward by an amount of displacement corresponding to the above-described one step.

When, by this operation as depicted in step S5, the ink ribbon 9 is shifted to the positions shown in FIG. 5 (A)–FIG. 5 (B) and the upper edge of the ink ribbon 9 is aligned with the detection point 18, thereby causing the detected output of the edge sensor 17 to become black, it has been determined that the upper end of the ink ribbon 9 has been detected at step S5. The vertical shift operation is then stopped at step S6, where the ink ribbon 9 is kept waiting at the position in FIG. 5 (B). Thus, the position in FIG. 5 (B) is made the initial position of the shift position of the stretched portion of the ink ribbon 9 in the vertical direction. This is the waiting position under non-printing situation.

When there has been an input of printing command at step S7, the step proceeds to step S8, where the stretched portion of the ink ribbon 9 is shifted upward from the position of FIG. 5 (B) to the upper-row printing position of the ink ribbon 9 shown in FIG. 5 (C). Under this state, the ink ribbon 9 faces the detection point 18 of the end sensor 17, and the white color of the back sheet 6 is not detected.

At step S9, then, the ribbon-feeding motor 33 is driven in accordance with necessity, and the ink ribbon 9 is longitudinally fed by a pitch corresponding to a printing pitch in the direction E in FIG. 2.

At step S10, the CPU determines whether or not the detected output of the end sensor 17 is white; that is, whether or not the end sensor 17 detects the white color of the end mark of the ink ribbon 9. When the result is negative, the previously-described printing operation of one character is performed at step S12.

At step S13, then, the CPU determines whether or not there is a continuous input of printing command from the keyboard 35. When there is a continuous input, the step returns to step S8, where the ensuing processing is performed. In that case, printing is successively performed by successively shifting the ink ribbon 9 to the printing positions of the upper row, middle row and lower row. FIG. 5 (D) shows a state in which printing has been performed by shifting the ink ribbon 9 to the lower-row printing position.

On the other hand, when there is no continuous printing command, the step proceeds to step S14, where the ink ribbon 9 is vertically shifted to the waiting position in FIG. 5 (B) so that the user of the typewriter can see printed characters. The step then returns to step S6, where the ensuing processing is performed.

Figure 6:
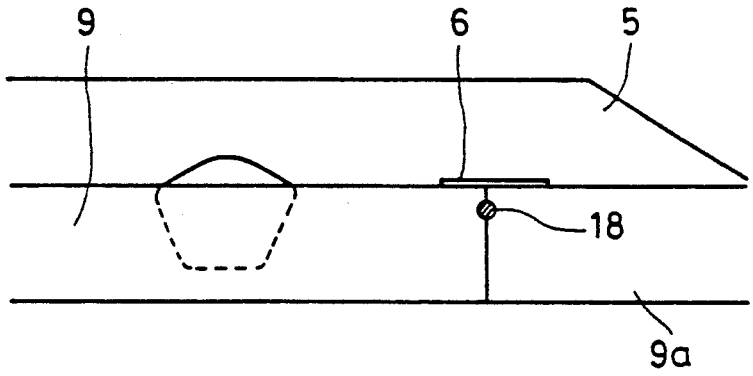
FIG. 6 is an explanatory diagram of an end-detection operation of an ink ribbon.

Printing is successively performed by repeating the processing after step S6 or after step S8, and therewith the ink ribbon 9 is successively fed in the direction E in FIG. 2 for use. When the portion of the white end mark **9*a* of the ink ribbon 9 then faces the detection point 18 of the end sensor 17 as shown in FIG. 6, and the detected output of the end sensor 17 becomes white at step S10, the step proceeds to step S11, where the user is informed of the fact that the end of the effective portion of the ink ribbon 9** has been detected, and the subsequent printing operation is prohibited.

As described above, according to the present embodiment, the initial position (waiting position under non-printing situation) of the vertical shift position of the ink ribbon 9 is detected, by detecting the upper edge of the stretched portion used for printing of the ink ribbon 9 using the end sensor 17 for detecting the edge of the effective portion of the ink ribbon 9. Hence, the vertical position of the ink ribbon 9 can be detected with a configuration which is less expensive than that when a separate exclusive sensor and its detection circuit are provided.

Figure 7:
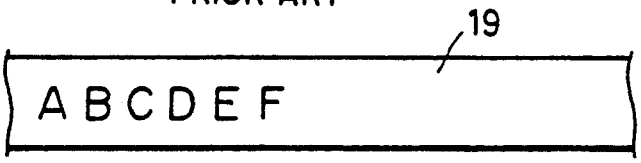
FIG. 7 PRIOR ART
FIG. 7 is an explanatory diagram of an ordinary ink ribbon and its state of application.

Also in a device in which a normal narrow ink ribbon shown in FIG. 7 is used and the entire width of the ink ribbon is utilized for printing of one character, when it is necessary to perform exact location control of the initial vertical position of the vertical shift position of the ink ribbon, the same configuration as that of the above-described embodiment can naturally be applied, and the same function and effect can also be expected.

What is claimed is:

1. A recording device comprising:

an ink ribbon cassette for housing an ink ribbon, with the ink ribbon including an end-indicating region;

shift means for shifting said ink ribbon cassette in plural stages, at least one stage being at a position capable of printing and at least one stage being at a position incapable of printing;

detection means for detecting the end-indicating region of the ink ribbon and for detecting an edge of the ink ribbon when said ink ribbon cassette is shifted by said shift means from a position incapable of printing to a detected first position capable of printing;

control means for successively controlling said shift means within a range of stages relative to said detected first position and capable of printing in accordance with a printing command when said detection means detects the edge of the ink ribbon.

2. A recording device according to claim 1 further comprising ribbon-feeding means for feeding said ink ribbon, said means being controlled by said ribbon feeding control means.

3. A recording device according to claim 2, wherein said shift means and ribbon-feeding means each include a motor, the motor of the ribbon-feeding means being driven by said control means.

4. A recording device according to claim 1, wherein when said detection means detects the end-indicating region of the ink ribbon, the control of said shift means is stopped and a notice of ribbon end is performed.

5. A recording device comprising:

a platen member;

an ink ribbon cassette for housing an ink ribbon that includes an edge-indicating region, said cassette including arms for outwardly drawing around the ink ribbon;

a card holder positioned between said platen member and the ink ribbon, said card holder having fixed thereto a backsheet with a detection point for indicating an initial position;

shifting means for shifting said ink ribbon cassette in plural stages, at least one stage being at a position capable of printing and one stage being an initial position incapable of printing;

detection means disposed facing the ink ribbon and for detecting the edge-indicating region of the ink ribbon and for detecting an edge of the ink ribbon when said detection point is covered by said ink ribbon, when said ink ribbon cassette is shifted by said shifting means from a position incapable of printing to a position capable of printing; and control circuit having means for successively controlling the shift means within a range of stages capable of printing in accordance with a printing command when said detection means detects the edge of the ink ribbon.

6. A recording device according to claim 5, wherein, said control circuit includes means to control said shift means so that it is shifted from the initial position of the cassette when said detection means detects said detection point.

7. A recording device according to claim 6, wherein said control circuit includes means to stop the shifting of said shift means and to notify the user of an abnormality when said detection means does not detect the detection point when starting.

8. A recording device according to claim 6, wherein said control circuit includes means to stop the shifting of said shift means until receipt of a printing command when said detection means detects the edge of the ink ribbon.

9. A recording apparatus for recording on a recording medium, comprising:

a removable ink ribbon cassette for housing an ink ribbon, with the ink ribbon having a printing portion and an end portion for indicating the end of the ink ribbon in the longitudinal direction;

shift means for shifting the ink ribbon between a recording position and a non-recording position;

recording means for recording on the recording medium;

a reflecting member disposed on the opposite side of the ink ribbon from said recording means, with said reflecting member reflecting a different amount of light than the printing portion of the ink ribbon;

detection means, disposed across from the ink ribbon, for receiving reflected light and detecting the end of the ink ribbon and a widthwise edge portion of the ink ribbon in accordance with the amount of reflected light; and control means for successively controlling said shift means within a range of stages relative to a detected first position and capable of printing in accordance with a printing command when said detection means detects the edge portion of the ink ribbon.

10. A recording apparatus according to claim 9, wherein said ribbon cassette houses an ink ribbon with a white end portion to indicate the end of the ink ribbon.

11. A recording apparatus according to claim 9, wherein said reflecting member is a white back sheet.

12. A recording apparatus according to claim 9, wherein said recording means includes a printing hammer.

13. A recording apparatus according to claim 9, wherein said detection means includes an optical sensor having an emission element for emitting light and a reception element for receiving the light emitted by said emission element.

* * * * *

UNITED STATES PATENT AND TRADEMARK OFFICE

CERTIFICATE OF CORRECTION

PATENT NO. :5,152,625

DATED :October 6, 1992

INVENTOR(S) :Ritsuo Machii

It is certified that error appears in the above-identified patent and that said Letters Patent is hereby corrected as shown below:

COLUMN 6:

Line 12, "edge sensor 17" should read --end sensor 17--.
Line 13, "end" should read --edge--.

COLUMN 7:

Line 38, "said means" should read --said ribbon-feeding means-- and "ribbon feed-" should be deleted.
Line 39, "ing" should be deleted.
Line 51, "edge-indicating" should read --end-indicating--.
Line 63, "edge-indicating" should read --end-indicating--.

COLUMN 8:

Line 6, "the" should read --said--.
Line 18, "the" should read --said--.

Signed and Sealed this

Thirty-first Day of January, 1995

Bruce Lehman

*Attest:*

BRUCE LEHMAN

*Attesting Officer*

*Commissioner of Patents and Trademarks*